US009185965B1

(12) United States Patent
Bhati

(10) Patent No.: US 9,185,965 B1
(45) Date of Patent: Nov. 17, 2015

(54) STRAP WITH DECORATIVE HOOK AND LOOP APPLIQUE

(71) Applicant: Rishi S Bhati, Algonquin, IL (US)

(72) Inventor: Rishi S Bhati, Algonquin, IL (US)

( * ) Notice: Subject to any disclaimer, the term of this patent is extended or adjusted under 35 U.S.C. 154(b) by 0 days.

(21) Appl. No.: 13/760,025

(22) Filed: Feb. 5, 2013

(51) Int. Cl.
*A45F 3/04* (2006.01)
*A45F 3/14* (2006.01)
*A45F 5/00* (2006.01)

(52) U.S. Cl.
CPC ... *A45F 3/14* (2013.01); *A45F 5/00* (2013.01); *A45F 2005/006* (2013.01)

(58) Field of Classification Search
CPC ..... A45F 3/14; A45F 5/00
USPC ..... 224/257, 258, 651; 2/301, 311, 338, 2/339
See application file for complete search history.

(56) References Cited

U.S. PATENT DOCUMENTS

| | | | | |
|---|---|---|---|---|
| 3,884,403 | A * | 5/1975 | Brewer | 224/257 |
| 4,337,938 | A * | 7/1982 | Rodriguez | 482/74 |
| 4,978,044 | A * | 12/1990 | Silver | 224/601 |
| 5,464,136 | A * | 11/1995 | Eddy | 224/666 |
| 5,607,092 | A * | 3/1997 | Alexander | 224/258 |
| 6,467,661 | B1 | 10/2002 | Mistretta et al. | |
| 6,688,316 | B1 * | 2/2004 | Klug | 132/286 |
| 6,769,204 | B1 | 8/2004 | Phillips | |
| 7,025,237 | B2 | 4/2006 | Herold | |
| 7,927,311 | B1 * | 4/2011 | Bachelder | 604/179 |
| 8,142,053 | B2 * | 3/2012 | Hurwitz | 362/249.16 |
| 8,425,072 | B2 * | 4/2013 | Hurwitz | 362/103 |
| 2002/0030072 | A1 * | 3/2002 | Schleifer | 224/257 |
| 2003/0160078 | A1 * | 8/2003 | Godshaw et al. | 224/607 |
| 2004/0084490 | A1 * | 5/2004 | Caputi | 224/257 |
| 2004/0238584 | A1 * | 12/2004 | Herold | 224/610 |
| 2005/0199661 | A1 * | 9/2005 | Johnson | 224/257 |
| 2006/0027616 | A1 | 2/2006 | Ranen | |
| 2007/0228091 | A1 | 10/2007 | Shawen | |
| 2008/0296325 | A1 * | 12/2008 | Tepper | 224/148.6 |
| 2010/0107310 | A1 * | 5/2010 | Taylor | 2/301 |
| 2011/0114683 | A1 * | 5/2011 | Lee | 224/257 |
| 2012/0048900 | A1 * | 3/2012 | Wong | 224/257 |
| 2012/0048901 | A1 * | 3/2012 | Wong et al. | 224/257 |
| 2012/0125360 | A1 * | 5/2012 | Hill et al. | 132/275 |
| 2012/0214013 | A1 * | 8/2012 | Namsaraeva | 428/542.2 |

OTHER PUBLICATIONS

Crafters-Guru Camera Strap Cover, http://craftersguru.blogspot.com/2010/03/camera-strap-cover.html, pp. 1-5 with one comment, Mar. 11, 2010, accessed Jun. 8, 2011.

(Continued)

*Primary Examiner* — J. Gregory Pickett
*Assistant Examiner* — Lester L Vanterpool
(74) *Attorney, Agent, or Firm* — Patents and Licensing LLC; Daniel W Juffernbruch

(57) ABSTRACT

A strap with an applique has a main strap with a hook and loop material on a length of a top side and a material on a bottom side. An applique comprises a decorative ribbon having a width substantially equal to a width of the main strap and a hook and loop material on one side. The main strap for a camera or the like is preferably stretchy and comprises a loop material on substantially an entirety of a top surface of the main strap. The applique comprises a hook material adhered beneath substantially an entirety of a surface of the decorative ribbon for coupling to the hook surface of the main strap. Connector straps are coupled to respective opposing ends of the main strap with a length adjustment mechanism.

12 Claims, 7 Drawing Sheets

(56) References Cited

OTHER PUBLICATIONS

Lindsay Phillips story flyer, one page, accessed Jun. 10, 2011.
Momshots.com camera-strap-cover-tutorials, http://www.momshots.com/camera-strap-cover-tutorials/, pp. 1-7 with four comments, Feb. 16, 2010, accessed Jun. 8, 2011.
Reversible Camera Strap Cover (second attempt), http://402centerstreet.blogspot.com/2009/10/reversible-camera-strap-cover-second.html, pp. 1-4 with three comments, Oct. 22, 2009, accessed Feb. 5, 2013.

* cited by examiner

STRAP WITH DECORATIVE HOOK AND LOOP APPLIQUE

BACKGROUND OF THE INVENTIONS

1. Technical Field

The present inventions relate to straps and, more particularly, relate to customizable straps for cameras or the like.

2. Description of the Related Art

Decorative camera straps have been used to hold a camera over a shoulder or arm. Logos, wording and decorative patterns and colors were within the fabric of such straps, often sewn or woven into the strap itself at the time of manufacture. What is needed is a more flexible camera strap where a logo, wording or decorative pattern or color can be chosen after manufacture.

BRIEF DESCRIPTION OF THE DRAWINGS

The present inventions are illustrated by way of example and are not limited by the accompanying figures, in which like references indicate similar elements. Elements in the figures are illustrated for simplicity and clarity and have not necessarily been drawn to scale.

The details of the preferred embodiments will be more readily understood from the following detailed description when read in conjunction with the accompanying drawings wherein:

FIG. 5B illustrates a close-up view of a buckle in a camera strap with an applique according to embodiments of the present inventions;

DETAILED DESCRIPTION OF THE PREFERRED EMBODIMENTS

Figure 1:
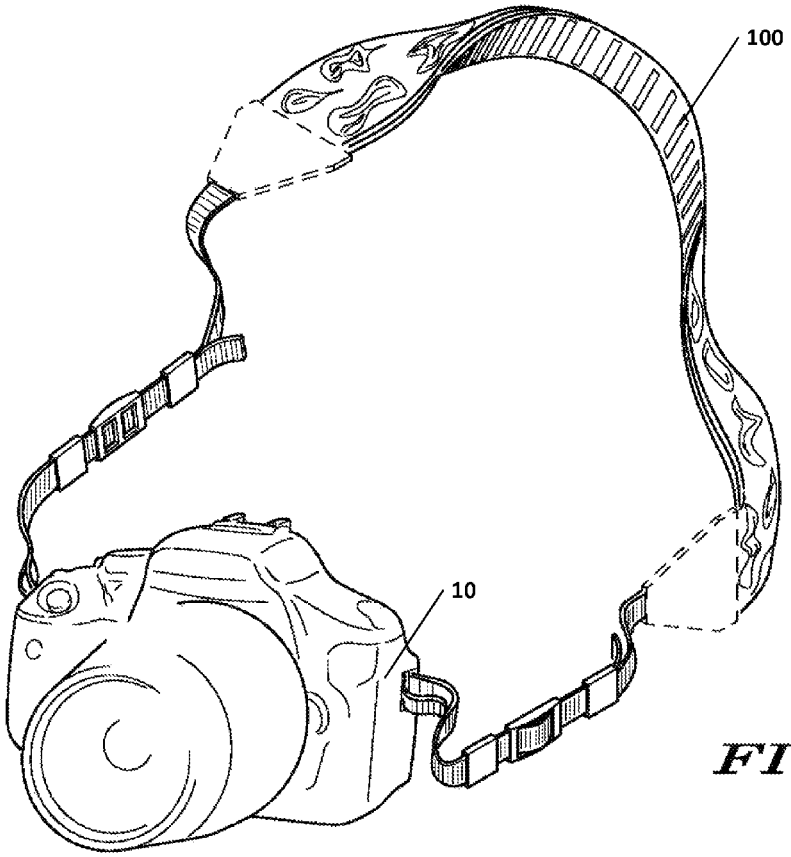
FIG. 1 illustrates an isometric diagram of a camera strap on a camera body according to embodiments of the present inventions.

FIG. 1 illustrates an isometric diagram of a camera strap 100 on a camera body 10 according to embodiments of the present inventions.

Figure 2:
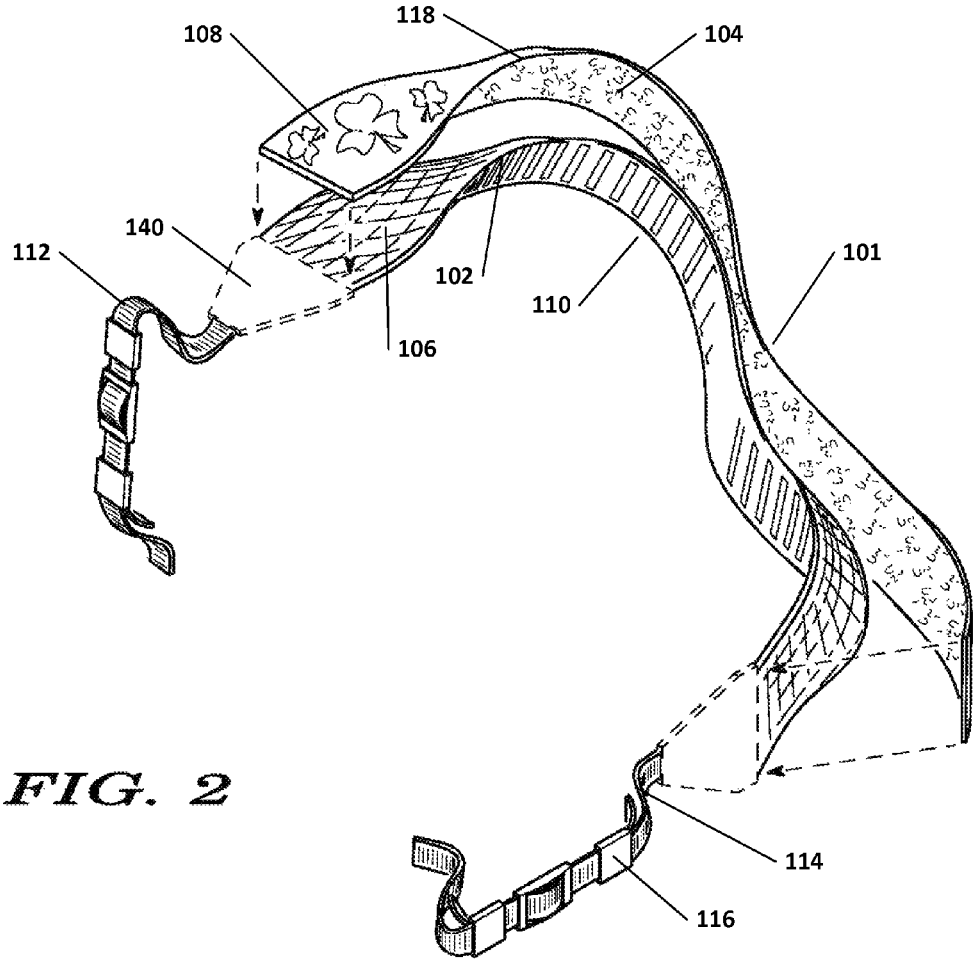
FIG. 2 illustrates an isometric exploded view of a camera strap with an applique according to embodiments of the present inventions.

FIG. 2 illustrates an isometric exploded view of a camera strap with an applique according to embodiments of the present inventions. A main strap 102 has a loop 106 material on a length of a top side 108 and a material 110 on a bottom side. First 112 and second 114 connector straps are coupled to respective opposing ends of the main strap, at least one of the first and second connector straps comprising a length adjustment mechanism 116. An applique 101 comprises a decorative ribbon 118 having a width substantially equal to a width of the main strap and a hook 104 material on one side.

The "hook and loop" material referred to herein is defined as a material having two opposing layers that stick together where one layer has a plurality of loops on one side and the other, opposing layer has a plurality of hooks on an side. Such "hook and loop" material is a generic description for material commonly sold under the trademark Velcro.

At least one of the main strap 110 and the applique 101 is stretchy and comprises the loop material. Preferably the main strap 110 is stretchy and comprises a loop material on substantially an entirety of a top surface of the main strap. The decorative ribbon 118 comprises a hook material adhered beneath substantially an entirety of a surface of the decorative ribbon for coupling to the loop surface of the main strap.

Figure 3:
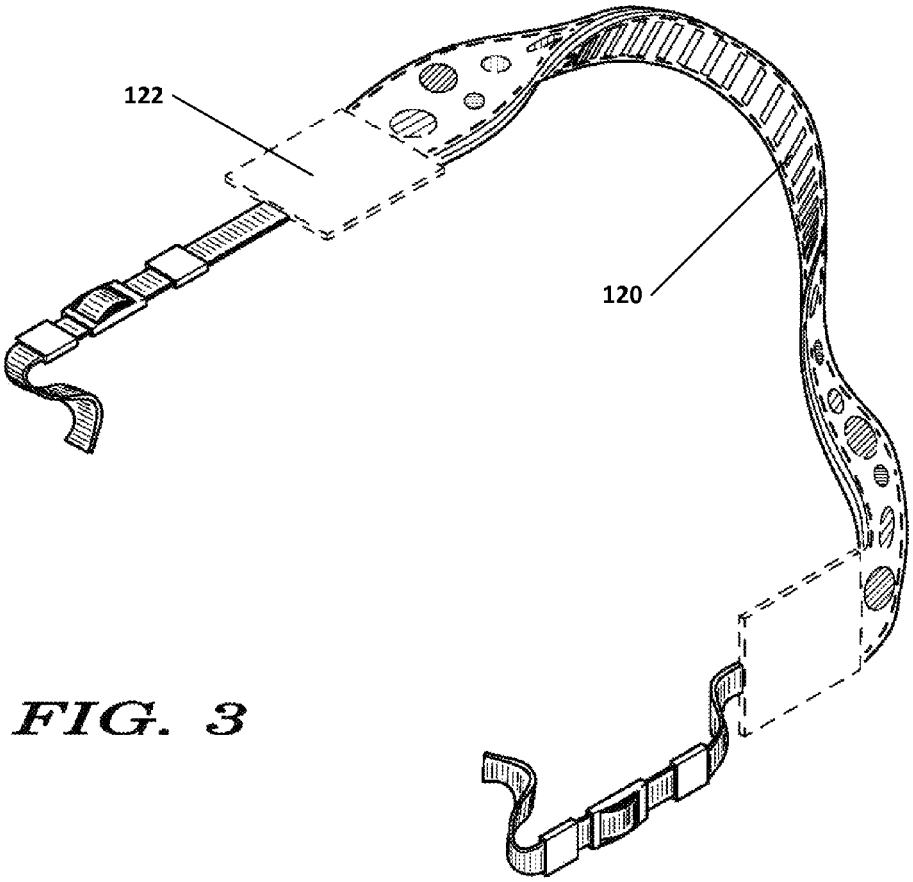
FIG. 3 illustrates an isometric view of a camera strap with an applique according to embodiments of the present inventions.

FIG. 3 illustrates an isometric view of a camera strap with an applique according to embodiments of the present inventions. The material on the bottom surface of the main strap 120 comprises a friction characteristic. The connector straps are coupled with a square tab 122 reinforcement overlay sewn into the main strap and its respective first and second connector straps.

Figure 4:
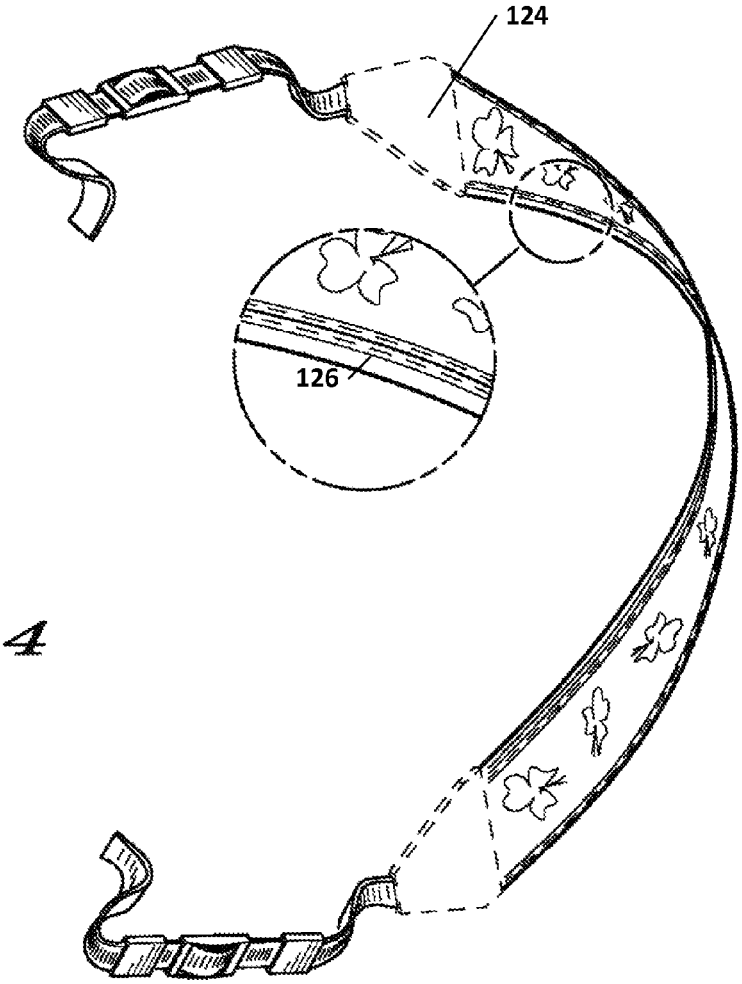
FIG. 4 illustrates a close-up view of layers in a camera strap with an applique according to embodiments of the present inventions.

FIG. 4 illustrates a close-up view of layers in a camera strap with an applique according to embodiments of the present inventions. The connector straps are coupled with a tapered 124 reinforcement overlay sewn into the main strap and its respective first and second connector straps. The main strap comprises five layers 126. The applique comprises three layers as will be described in more detail in FIG. 5A.

Figure 5A:
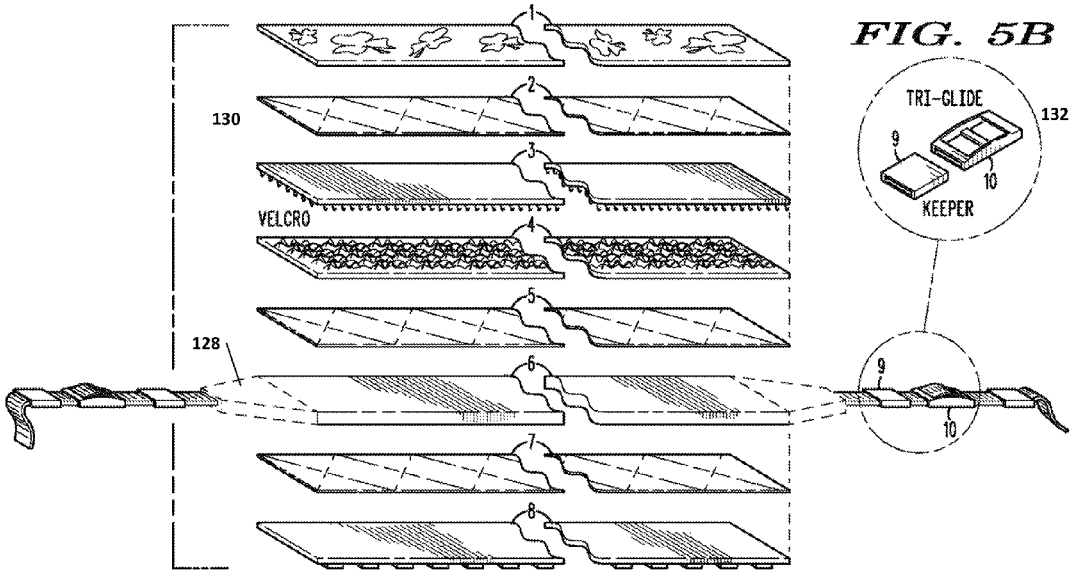
FIG. 5A illustrates a view of layers in a camera strap with an applique according to embodiments of the present inventions.

FIG. 5A illustrates a view of layers in a camera strap with an applique according to embodiments of the present inventions. The main strap comprises five layers 128. The applique comprises three layers 130.

FIG. 5B illustrates a close-up view of a buckle in a camera strap with an applique according to embodiments of the present inventions. The length adjustment mechanism comprises a tri-glide and keeper 132.

Figures 6A, 6B:
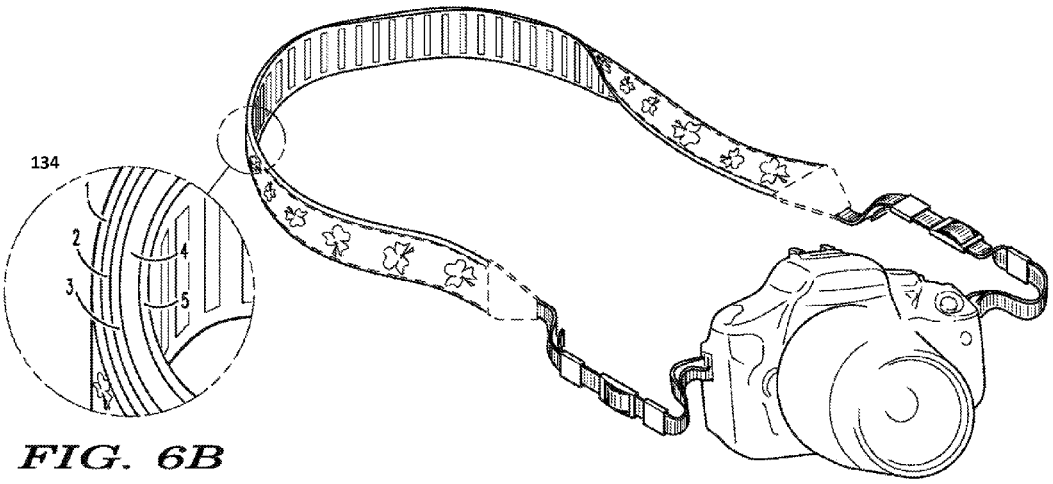
FIG. 6A illustrates an isometric diagram of a camera strap on a camera according to embodiments of the present inventions.
FIG. 6B illustrates a close-up view of five layers in a camera strap with an applique according to embodiments of the present inventions.

FIG. 6A illustrates an isometric diagram of a camera strap on a camera according to embodiments of the present inventions.

FIG. 6B illustrates a close-up view of five layers 134 in a camera strap with an applique according to embodiments of the present inventions. While FIG. 6B illustrates only 5 layers, there are 8 layers illustrated in FIG. 5A due to the 3 glue layers which are not illustrated in FIG. 6B. The embodiment of FIG. 6B can preferably has all three glue layers.

Figure 7:
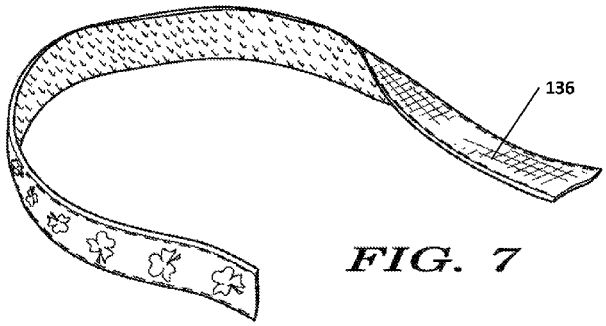
FIG. 7 illustrates a view of an applique for a camera strap according to embodiments of the present inventions.

FIG. 7 illustrates a view of an applique 136 for a camera strap according to embodiments of the present inventions.

Figure 8:
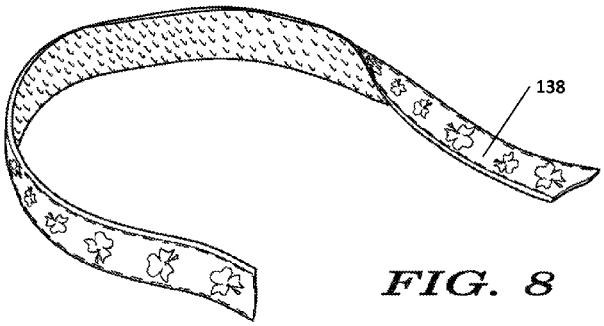
FIG. 8 illustrates a view of another applique for a camera strap according to embodiments of the present inventions.

FIG. 8 illustrates a view of another applique 138 for a camera strap according to embodiments of the present inventions.

A camera strap kit has the main strap 102 of FIG. 2, first and second connector straps, e.g., 112 and 114 of FIG. 2; and a plurality of different appliques, e.g., 101 of FIG. 2, 136 of FIGS. 7 and 138 of FIG. 8.

This design is for a camera strap with interchangeable appliques or "uppers" 136, 138. The length of the strap is 34-36 inches in the body of the strap/interchangeable piece. I plan to offer various lengths of the strap body in the future (example 28" or 30").

The strap is made of several parts, namely the 1) Strap body 6 with Loop Adhesive 5/Velcro Loop tape 4, the 2) Strap upper/Applique 1/Hook 2 Adhesive 3, the 3) End Pieces 140, and the 4) Extension/Connector 112, 114.

The Strap body with Loop Adhesive/Velcro Loop tape is a first part of the strap.

The purpose of the camera strap is to be worn around a person's neck or shoulder to support the weight of the camera with the camera body. It needs to be comfortable to reduce strain on the neck. In this case we have used neoprene (rubber); however a number of soft and comfy materials can used in any future modifications. The Strap Body has a core made from cushioning and a lower grip layer 8. This grip layer can be glued 7 to the lower part of the Strap Body and/or sewn on to it. The width of the Strap Body is 2 inches and can change based on future designs.

This camera strap has a dual purpose, support the camera weight and to adorn the strap. The strap is adorned via various colorful/decorative fabric/vinyl/leather mounted on a Strap Upper (mounted using a Velcro™ tape) which is attached to Strap Body.

The Strap Body needs to have an attachable surface as an attachment point for decorative Strap Uppers/Applique mounted on Velcro hook tape.

The top of the Strap Body has a Velcro™ loop tape on it (also referred to as Loop Adhesive). This loop is attached to the upper surface of the Strap Body by the following method: Primarily Glued to the surface. This may cause the edges to peel off over time, to prevent this a binder tape is sewed over the edges of the Strap Body to secure the edges of this loop tape. Also this loop tape may be attached to the Strap Body by ONLY using an edge binding and no glue.

In summary, the end construction consists of a Velcro loop tape glued to the Strap Body and its edges secured along the length with a binder tape stitched onto the edge. This secures the sides of the Velcro tape. The top and bottom of the tape are secured by embedding them in the triangular 124 or square 122 End Pieces.

The Strap body 6 needs to be made from a soft cushion material such as neoprene and needs to be slightly stretchy. This is because the Strap Upper will attach onto it with Velcro "hook" 3 type attachment ribbon. This Velcro hook ribbon does not stretch and is non-elastic. Most of the Velcro hook tapes are non-elastic. Due to the nature of its use, the camera strap needs to be stretchy since it will be worn around a person's neck. This can cause a problem if both, the Strap Upper and Strap Body are non-elastic. Hence we chose to design the Strap Body to be made from elastic neoprene material. When the strap bends around the neck, the elastic Strap Body conforms to the bend and maintains a non-buckling attachment with the upper hook Velcro.

A converse attachment mechanism from that described above—having the Strap Body top with a non-elastic Velcro hook tape and the Strap Upper made from an elastic Velcro loop material did not work when the main strap was made of a non-stretchy material. This was because once the applique is attached to the elastic Velcro loop material, it will prevent it from being elastic and there will be buckling when attached to the non-elastic Strap Body. The stretch property preferably goes with the loop side material because the hook material is typically more difficult of not impossible to stretch. Also, one of the main strap or the applique really needs to be stretchy or the camera strap will buckle when bent in use.

The Strap upper/Applique/Hook Adhesive is a second part of the strap. The Strap upper/Applique/Hook Adhesive consists of a decorative "surface" or Applique (fabric/vinyl/leather) ribbon attached/bonded to a Velcro hook tape 1 which is attached to the Strap Body's Velcro loop surface 106.

The decorative applique is attached to the Velcro hook tape 3 by—Sewing its 4 sides along all edges, sewing 4 edges along 4 sides AND gluing the tape to the Velcro hook tape or just gluing the applique to the Velcro tape (hook adhesive). The width of this applique is 1.5 inches however this may change based on business requirements or based on future designs.

The End Pieces are a third part of the strap. The End Pieces are triangular 124 or slightly trapezoidal 122 in shape according to the several embodiments. These are essentially tapering in order to effectively connect the camera Strap Body to the Extension/Connectors. These are made from vinyl however can be made from leather or fabric as well.

The Extension/Connector is a fourth part of the strap 112, 114. The Extension/Connector is a webbing 0.5 inches wide used to attach the camera strap to the sides of the camera. The dimension of 0.5 inches is what fits typical cameras. This webbing is 15-16 inches long on each side. It is preferably fastened by using 2 keepers and 1 tri-glide made from plastic (can be metal too) 132. It is fastened by looping it around the camera attachment, then passing it through the keepers and the tri-glide for a secure fit.

While the preferred embodiments illustrate the straps are shoulder and neck straps for carrying a camera, such as a single lens reflex SLR camera body, the straps of the present inventions can be used to carry other objects such as binoculars, briefcases, luggage, rifles and shotguns, or guitars and banjos and ukuleles.

Any letter designations such as (a) or (b) etc. used to label steps of any of the method claims herein are step headers applied for reading convenience and are not to be used in interpreting an order or process sequence of claimed method steps. Any method claims that recite a particular order or process sequence will do so using the words of their text, not the letter designations.

Unless stated otherwise, terms such as "first" and "second" are used to arbitrarily distinguish between the elements such terms describe. Thus, these terms are not necessarily intended to indicate temporal or other prioritization of such elements.

Any trademarks listed herein are the property of their respective owners, and reference herein to such trademarks is generally intended to indicate the source of a particular product or service. In the case of Velcro or Velcro loop or Velcro tape, applicant refers to a hook and look closure.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure. For example, appropriate modifications can be made with future technology such as new or different gluing mechanisms.

What is claimed is:

1. A strap with applique, comprising a middle strap with a hook and loop material on a length of a top side and a material on a bottom side;

first and second connector straps attached at respective distal ends at respective reinforcement overlays to respective opposing ends of the middle strap, at least one of the first and second connector straps comprising a length adjustment mechanism, wherein the first and second connector straps are narrower than the middle strap; and an applique comprising a decorative ribbon having a width essentially equal to a width of the middle strap and a length essentially equal to a length of the middle strap and a hook and loop material on one side; and wherein the distal end edges of the decorative ribbon of the applique comprises a flat planar edge portion that abuts or contacts and matches the distal edge portions of the reinforcement overlays opposite the first and second connector straps; and wherein, when the applique comprising the decorative ribbon is connected to the middle strap, the reinforcement overlay and the applique has a smooth flush planar cohesive surface.

2. A strap according to claim 1, wherein the middle strap is stretchy and comprises the loop material and the applique is less stretchy and comprises the hook material.

3. A strap according to claim 1, wherein the middle strap is stretchy and comprises a loop material on essentially an entirety of a top surface of the middle strap; and wherein the applique is less stretchy than the middle strap and comprises a hook material adhered beneath essentially an entirety of a surface of the decorative ribbon for coupling to the hook surface of the middle strap.

4. A strap according to claim 3, wherein the material on the bottom surface of the middle strap comprises a friction characteristic.

5. A strap according to claim 3, wherein the strap is a camera strap.

6. A strap according to claim 5, wherein the middle strap comprises at least five layers; and wherein the applique comprises at least three layers.

7. A strap according to claim 5, wherein the length adjustment mechanism comprises a tri-glide and keeper.

8. A strap according to claim 5, wherein each of the reinforcement overlays comprise tapered reinforcement overlays sewn into the middle strap and its respective first and second connector straps.

9. A strap kit according to claim 1, comprising the middle strap, first and second connector straps; and a plurality of different appliques.

10. A strap kit according to claim 3, comprising the middle strap, first and second connector straps; and a plurality of different appliques.

11. A strap kit according to claim 5, comprising the middle strap, first and second connector straps; and a plurality of different appliques.

12. A strap according to claim 1, wherein each of the first and second connector straps is a webbing having a width of 0.5 inches.

* * * * *